US005456495A

United States Patent [19]

McLeod

[11] Patent Number: 5,456,495

[45] Date of Patent: Oct. 10, 1995

[54] TOE THRUSTING EDGE BLADE FOR GOALIE SKATES

[76] Inventor: John A. McLeod, 50 Indian Grove, Toronto, Ontario, Canada

[21] Appl. No.: 249,481

[22] Filed: May 25, 1994

[30] Foreign Application Priority Data

May 25, 1993 [CA] Canada ..... 2096857

[51] Int. Cl.[6] ..... A63C 3/00

[52] U.S. Cl. ..... 280/811; 280/11.12; 36/115

[58] Field of Search ..... 280/11.12, 11.17, 280/11.18, 11.15, 809, 811, 825; 36/115, 132

[56] References Cited

U.S. PATENT DOCUMENTS

| | | | |
|---|---|---|---|
| 1,806,975 | 5/1931 | Johnson | 280/811 |
| 1,826,616 | 10/1931 | Johnson | 280/811 |
| 2,485,923 | 10/1949 | Rumpakis et al. | 280/811 |
| 2,920,897 | 1/1960 | Jensen . | |
| 3,120,397 | 2/1964 | Lepkofker . | |
| 3,181,879 | 5/1965 | Hodges . | |
| 3,806,145 | 4/1974 | Czeiszperger | 280/811 |
| 3,934,892 | 1/1976 | Baikie | 280/11.12 |
| 4,453,727 | 6/1984 | Bourque . | |

FOREIGN PATENT DOCUMENTS

| | | | |
|---|---|---|---|
| 3326154 | 6/1984 | Germany | 280/11.12 |
| 72925 | 12/1947 | Norway . | |
| 8100056 | 7/1981 | WIPO . | |

*Primary Examiner*—Karin L. Tyson
*Assistant Examiner*—Carla Mattix

[57] ABSTRACT

A pair of toe thrusting blades for attachment to goalkeeper ice skates which are attachable to the underside of the toe of the boot and extend sideways and forwards at the toe of the boot which are normally clear of the ice but which will engage the ice when the goalkeeper rolls his foot at an extreme angle.

5 Claims, 3 Drawing Sheets

TOE THRUSTING EDGE BLADE FOR GOALIE SKATES

FIELD OF THE INVENTION

The invention relates to ice skates and in particular to toe-thrusting edge blades for skates used by goal keepers in ice hockey.

BACKGROUND OF THE INVENTION

In hockey, the goaltender occupies a unique position. While other players can roam the ice, the goalie is restricted to his immediate goal area. This fact dictates the type of skating each player will do. Forwards skate at high speeds, going forward, backward and turning with little or no side-to-side movement. Goaltending, however, requires rapid side-to-side (lateral) motion with only some forward and backward movement.

Therefore goalies' skates differ in design from other hockey skates. A goalie skate is constructed to withstand the impact of the puck. The other main difference, namely that goalie skates sit lower to the ice, actually hinders some lateral movement. However, there is nothing in the design to accommodate the radically different movement requirements.

The basic mechanics of side-to-side movement are the same whether on skates or not. One leg supplies the thrust, or push, while the other leg moves. On goalie skates, however, problems develop concerning the inability of the thrusting leg to remain fixed for maximum power.

The main difficulty is that as a goalie pushes off, the thrusting foot rolls, and the toe side of the boot rolls closer to the ice. As soon as the boot touches the ice, the foot will lose its grip and slip. This is because the boot, when it contacts the ice, will now act as a fulcrum or a lever and lift the skate blade off the ice. All goalie skates will have this problem because the boots sit lower to the ice than the boots of regular forward skates. There are two factors determining how quickly the blade slips.

The first concerns the height of the blade. Skates need to be sharpened regularly, which means grinding them down. As a blade gets ground down, or lower, the angle of contact between the boot and the ice becomes less acute. This means the goalie slips earlier in the thrusting movement.

The second factor concerns the sharpness of the skate blade. The purpose of sharpening skates is to get a better grip on the ice. Paradoxically however, goaltenders prefer their skates to be slightly dull. This is because it is essential that goalie skates also slide sideways, against the grain, so to speak. The negative side of this trade-off comes with the thrusting movement which requires a well planted foot to push off from. If the dull skate is to grip at all, it will have to be at a more acute angle. This means the boot will contact the ice sooner, the thrusting motion will be shorter and the goalie will fall.

In the light of these problems it is desirable to provide a means for gripping the ice temporarily, when the boot is rolled at an extreme angle, to make a power thrust to one side or to the other. However, clearly whatever additional gripping means are provided, they must not interfere with the normal skating action of the blades, and must not require any unusual body movements or contortions in order to bring the gripping means in to use.

In the past, it has been proposed, in Norwegian Patent number 72,925 to provide what appear to be auxiliary cornering blades, on a pair of speed skates. The apparent intention was to enable the speed skater to maintain speed, while traversing a curve on a speed skating course. The sport of speed skating differs substantially from hockey. In speed skating two speed skaters circle a continuous loop course having straight portions and curved ends, and are usually required to maintain separate lanes throughout most of the loop, and to change lanes only at predetermined distances in the race. The skaters must therefore maintain the highest possible speed on the curves at each end of the course, in their respective lanes, and also during the lane changeover.

Such speed skating skates are of an unusual design being of considerable length, greater than the length of the boot to which they are attached, and having essentially elongated linear edges. The proposal in the abovenoted Norwegian Patent involved the placing of auxiliary corner stabilising blades, approximately mid-way along the length of the blade. Apparently, the intent was that both the straight main blade, and also the auxiliary blade, should engage the ice simultaneously, when traversing a corner, so as to assist the skater in maintaining stability without loss of speed. It cannot be determined at this time whether this proposal ever met with any commercial success.

Clearly however it would be of no application to the type of skates used in hockey. Such skates are much shorter than speed skates. In addition they are sharpened so as to have a predetermined longitudinal profile which is generally convex, so as to permit the players to make abrupt turns during the game. It is known that players in some positions prefer the convexity of the skates to be either advanced towards the front, or towards the back of the skate. Goalies prefer a flatter blade, less convex, for balance, with the ends rockered. However, even the profile of a goalie blade is such that a goalie blade sitting on a flat surface will probably only have about two inches of blade in contact with the surface. This is because the goal keeper moves rapidly from side to side. Usually, the goalie will use the ball of his foot, and even the toes of the foot, to provide the powerful sideways thrust required to move his body quickly from one side to the other of the crease.

Consequently, the proposal shown in the aforesaid Norwegian Patent would be of no application to goalie skates used in hockey and if anything would prevent goalies from making the side-to-side movements on the ice, which are required in the game.

BRIEF SUMMARY OF THE INVENTION

With a view therefore to overcoming the various problems noted above in relation to goal keeper skates, the invention provides a pair of toe thrusting edge blades for use with goalie hockey skates of the type having a blade attached to a boot sole, said blade defining forward and rear ends, the forward end being located adjacent to the toe of the boot, and said blade defining an inside edge and an outside edge, and said toe thrusting blade comprising, a plate portion attachable to said toe of said boot adjacent to and extending transversely outwardly with respect to said skate blade, spaced from said inside edge, a free edge portion on said plate portion extending from said inside edge of said toe of said boot, and, a thrusting blade edge formed along said free edge portion, whereby said thrusting blade edge of said toe thrusting blade is in contact with the ice surface when the skate on an outthrust foot rolls over at said toe at extreme angles to the ice surface. The extreme angles are from 20° to 45° when said free edge portion extends 1/16" from said inside edge of said toe of said boot.

The invention further comprises such toe thrusting edge blades and wherein said plate portion comprises a generally planar plate of sheet steel, defining a curved longer side, and wherein said edge portion is defined along said curved longer side.

The curved longer blade edge defines a first blade edge for initial gripping of the ice when the skate on an outthrust foot rolls over with the heel of said boot still on the ice, a second blade edge continuously extending from said first blade edge for gripping the ice when the heel is lifted up, and a third blade edge continuously extending from said second blade edge for continuous gripping of the ice when the heel is further lifted up. The first blade edge defines an arc of radius R2, the second blade edge defines an arc of radius R1, and the third blade edge defines an arc of radius R3, where R1 is greater than R2 and R2 is greater than R3.

The invention further comprises such toe thrusting edge blades and wherein said free edge forms said thrusting blade edge. The free edge portion extends 1/16" to 1/32" from said inside edge of said toe of said boot.

The invention further comprises such toe thrusting blades and wherein said plate portions incorporate attachment means formed therein, whereby the same may be secured to the toes of a pair of boots, adjacent to said forward ends of said skate blades.

The invention further comprises, in combination, a pair of boots having soles defining a toe and a heel, and skate blades secured to said soles, said skate blades defining forward and rear ends, and toe thrusting blades secured to said toes of said boots, adjacent to but spaced transversely from said forward end of said skate blades.

The invention further comprises such a combination wherein said skate blade defines a vertical longitudinal axis extending therealong, and wherein said toe thrusting blade defines a sharpened edge, portions of said sharpened edge lying on an axis angled to converge with said vertical longitudinal plane.

The invention further comprises such a combination, wherein said boot sole is formed at least in part, of moulded plastic material and defines a recess adjacent the toe thereof, and wherein said plate portion of said toe thrusting blade is received in said recess in said plastic material.

The various features of novelty which characterize the invention are pointed out with more particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

DESCRIPTION OF A SPECIFIC EMBODIMENT

As already mentioned, the invention is directed towards the provision of a pair of toe thrusting blades for a pair of goalie hockey skates which enables the goalie to make sideways thrusting movements to one side or the other, of his body, and in so doing, to place the skate blades of the thrusting boot at an extreme angle to the ice surface and to point his toe while doing so. As mentioned, in many cases, and in particular where the blades have been ground down so that they are no longer the original height of the new blades, the edge of the boot has a tendency to contact the ice, thereby lifting the blade off the ice and preventing it from gripping the ice. The majority of such thrusting movements are made by players pointing the toe of the one foot, (the thrusting foot), and using the ball of the foot and the toes so as to obtain maximum power in the sideways thrust.

Whatever aid is provided to assist in the sideways toe thrusting movements of the goalie skates, therefore must not interfere with his normal movements during the game.

Figure 1:
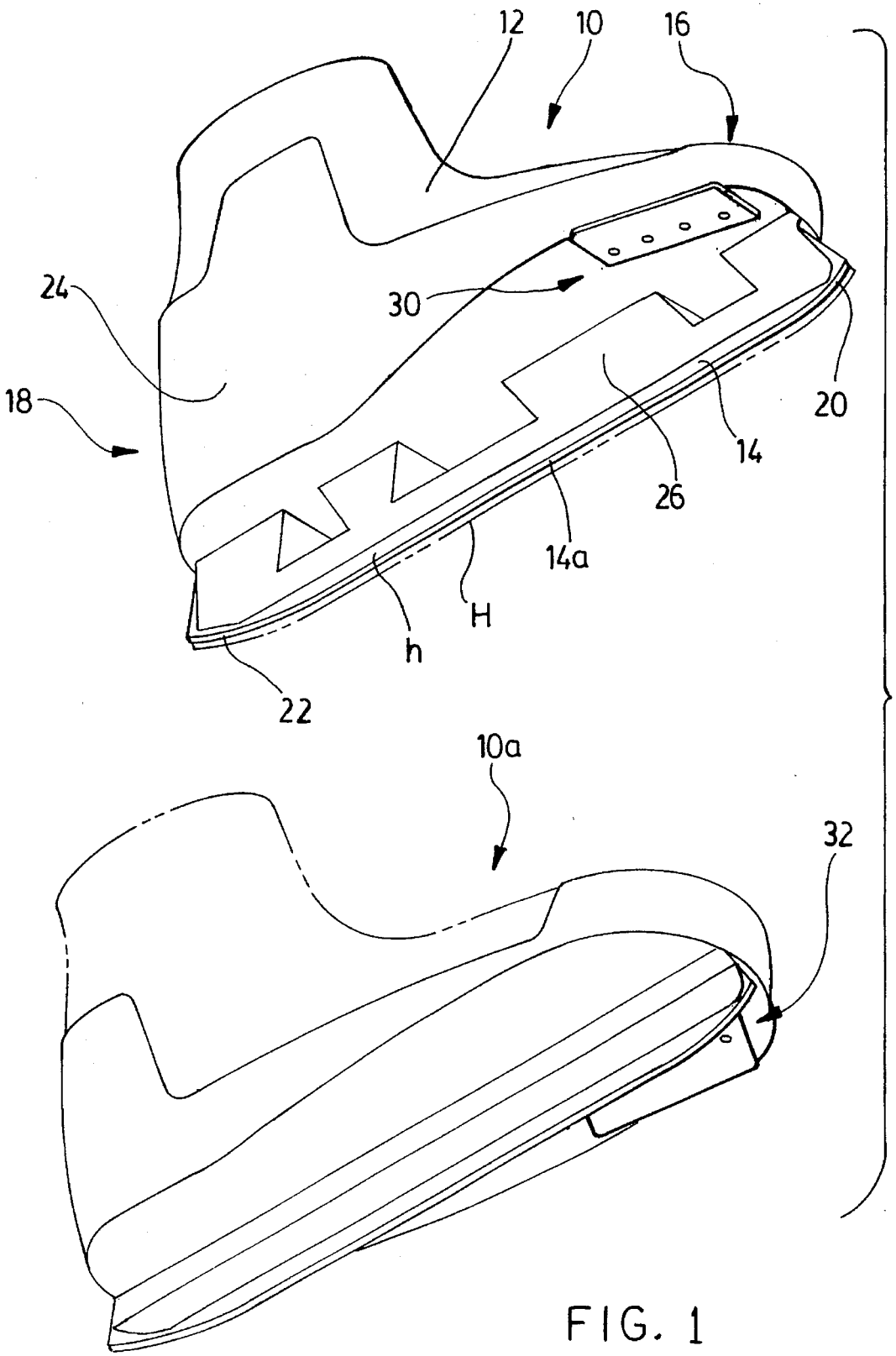
FIG. 1 is a perspective illustration of a left boot and skate, the right boot and skate being shown in phantom.
Figure 2:
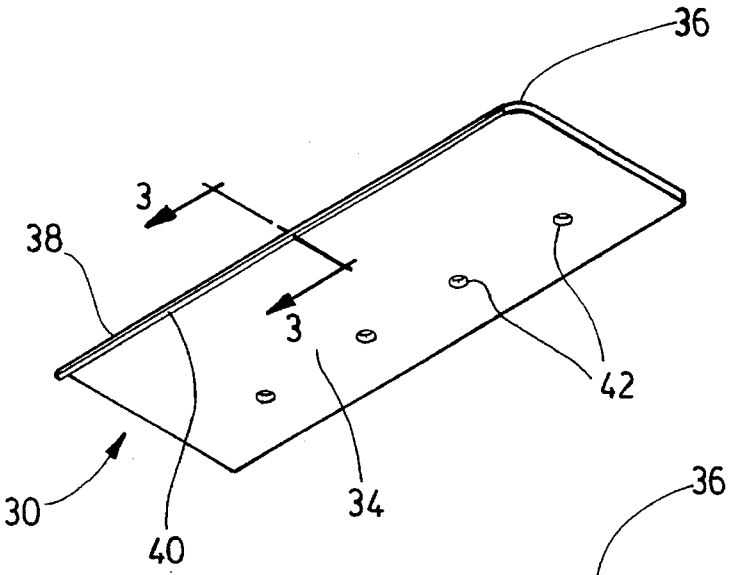
FIG. 2 is a perspective view of an embodiment of a toe thrusting blade according to the invention, the left toe thrusting blade being shown in this case, the right toe thrusting blade simply being a mirror image thereof.

Referring now to FIG. 1, the invention is there illustrated in the form of a hockey skate indicated generally as 10. The skate 10 illustrated is the left skate. The right skate **10*a* is illustrated in phantom, but will have features which are the same as those described in relation to the left skate 10**.

Each skate 10 of the pair consists of a boot 12 and a skate blade 14. The boot 12 has a toe 16 and heel 18, and the blade has a forward end 20 and a rear end 22.

The blade may be attached to the boot by any suitable means such as rivets (not shown) or other fastening devices. In goalie skates the blade is usually secured in an integrally moulded blade support (see below) which is usually part of the sole of the boot.

In the particular case of boots for goaltenders, the boot shell 24 is intended to provide padding along either side and around the toe and heel of the boot, to withstand the impact of the puck during play. The shell, and the way it is secured to the boot are well known in the art. The shell 24 usually has an integral blade holder 26 of moulded plastic. The blades 14 are usually lower than blades for hockey players in other positions.

As will be seen, the blade 14 is received in holder 26 and a lower portion **14*a*** of the blade extends downwardly from the moulded plastic shell, for engaging the ice. It has a longitudinal running surface, and upwardly curved forward and rear ends. The longitudinal running surface is in fact convex along its length, and is normally formed with a high point somewhere between the two ends. The running surface is also formed with a transverse section which is slightly concave, in a well-known manner.

As shown in phantom, the blade may have had an original height of H, and, after several sharpenings and grindings will have a reduced height h (FIG. 1).

It will thus be apparent that when the blade height h is reduced, and the skate is rolled over at an extreme angle, the edge of the boot, or at least the edge of the protective shell, will touch the ice causing the edge of the blade to lift off the ice, and the foot will slip. It has been determined that these thrusting movements are usually made from the ball and toes of the thrusting foot, so as to achieve all of the power of the leg muscles, and also power from the movement the ankle. If the goalie slips when at this extreme degree of stretch, he will almost inevitably fall to the ice.

As mentioned above, the invention is directed to overcoming this problem.

Referring again to FIG. 1, the invention will be seen to comprise generally a pair of toe thruster blades one being indicated generally as 30, and a similar but mirror image thruster 32 being provided on the other boot.

Both thrusters are adapted to be located on the inside edge of the boot adjacent to the toe. Each thruster in the pair can be seen to comprise a generally planar or plate portion 34 in this case of a generally rectangular shape, although any other shape which might fit a boot could be suitable. Along the one edge of the plate 34, an inwardly directed edge portion 36 is defined. Along the free edge 36, a sharpened edge is formed by the two surfaces 38 and 40, ground on upper and under surfaces of the edge 36, so as to form a sharpened edge, orientated to securely engage the ice surface, when the boot is rolled over at an angle.

In order to secure the plate portion 34 to the under surface of the shell, or to the sole of the boot, the plate portion 34 is formed with a plurality of spaced apart openings 42. In this way, by selecting the appropriate openings for the insertion of fastenings, such as, for example rivets, the plate portion can be secured in the desired orientation, in a manner to be described below.

Figure 4:
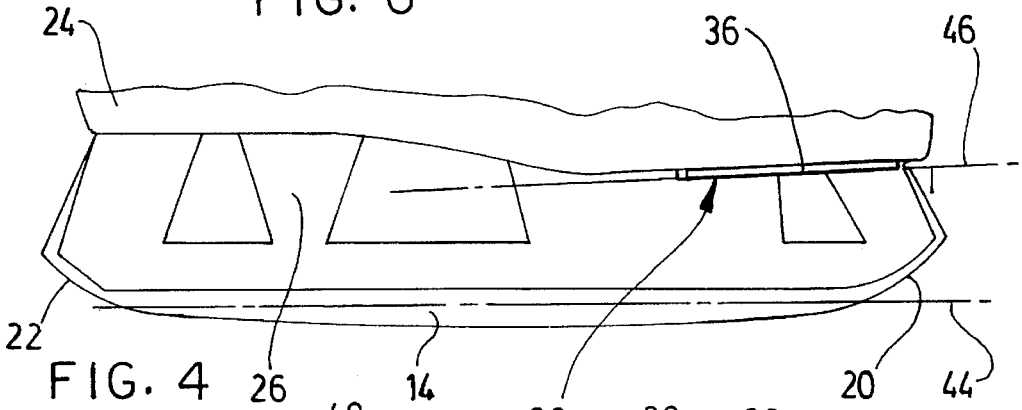
FIG. 4 is a side elevation of the toe portion of the boot and skate of FIG. 1.
Figure 5:
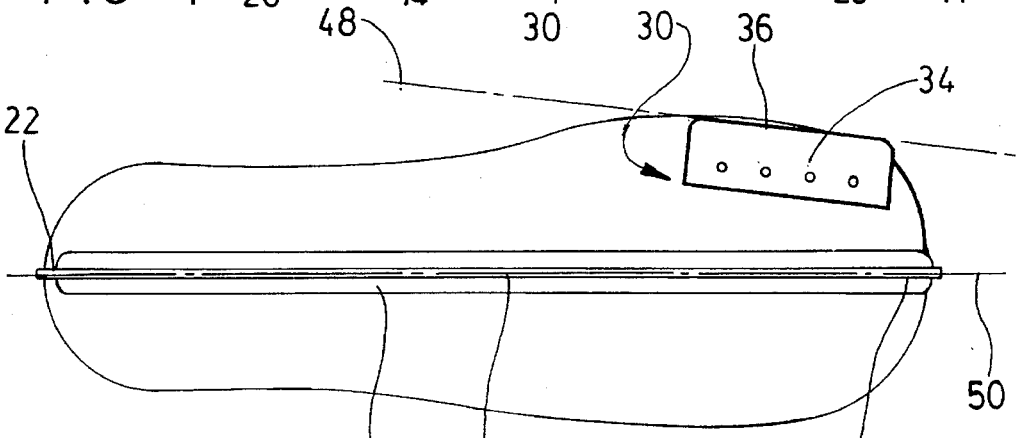
FIG. 5 is a lower plan view of a boot and skate showing the axis of the toe thrusting blade.

From FIG. 4, it can be seen that the plate portion is secured to the boot, or to the shell, in such a way that the skate blade 14 defines an axis 44, which maybe considered as being essentially horizontal to, but spaced from the ice, when the skate blade is in its normal skating position. The plate portion 34 of the thruster lies in a plane 46. The plane 46 lies at an upwardly acute angle to the axis 44 of the skate blade. In this way, the free edge portion with its sharpened edge lie along the axis 44 which is angled upwardly, from the rear to the front of the skate. It will also observed from FIG. 5 that the sharpened edge 38–40 of rib 36 lies along an axis 48 which converges at an acute angle with a forward projection of the central longitudinal plane 50 of the blade itself.

Figure 6:
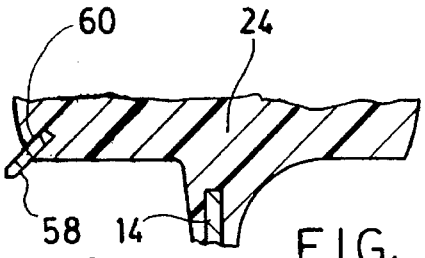
FIG. 6 is a front elevation of an alternate form of boot and skate, partially cut away to reveal its construction.

As shown in FIG. 6, a modified blade 58 may be secured in a different manner. In this embodiment, the boot shell 24 may be moulded with a recess 60 adjacent the toe, and opening to the inside of the shell. The blade 58 may be secured in, or even integrally moulded in, the recess, leaving only a portion thereof extending outwardly. Some boots are formed with soles and skate supports moulded integrally in one piece, similar in many respects to the moulding of the boot shell 24. In this case also recesses 60 may be formed, and the blades secured in, or moulded in the recesses. By this expedient, it is ensured that when the goalie makes a sideways toe thrust off one skate, and when he raises his heel and points his toe to obtain the maximum reach for his thrust, the toe thruster blade edge 58 will engage the ice surface in such a manner as to obtain the maximum grip on the ice.

Figure 3:
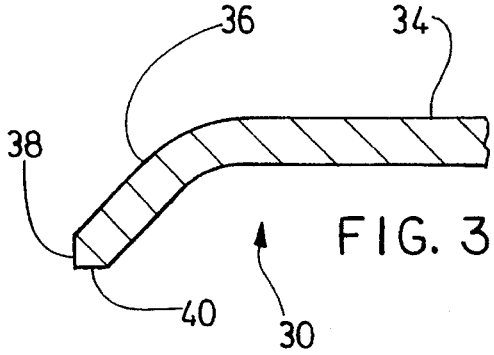
FIG. 3 is a section along line 3—3 of FIG. 2.

The blades are flat and planar, as shown in FIGS. 1, 4, 5 and 6, but in some forms of blade, an edge portion may be bent downwardly, as shown in FIG. 3, if desired.

Figure 7:
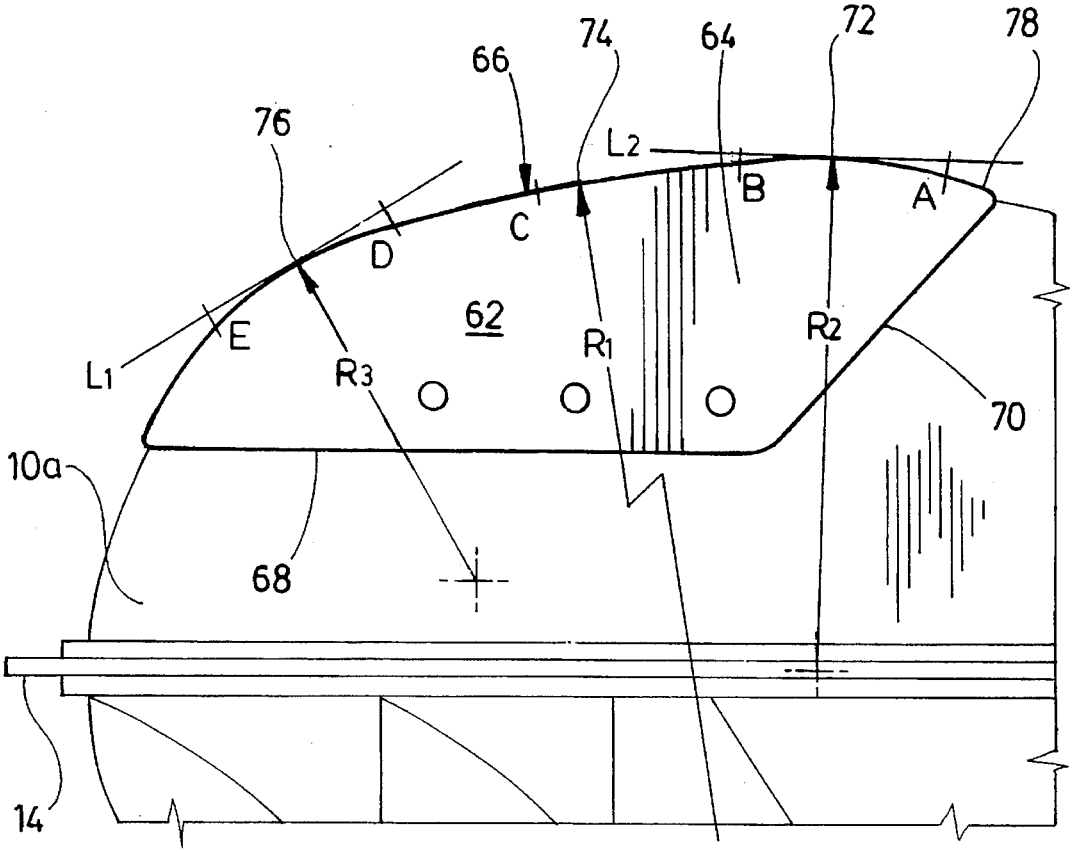
FIG. 7 is a plan view of another embodiment of a toe thrusting blade.

FIG. 7 is a plan view of another embodiment of a toe thruster blade 62 of the present invention.

The toe thruster blade 62 is adapted to be attached on the inside edge of the toe of either a left or a right skate boot. It is an advantage in that the same toe thruster blade can be used for both left and right skates. This reduces the cost of manufacture.

The toe thruster blade 62 comprises a planar plate portion 64 defining a generally curved longer blade edge 66, a generally straight first blade edge 68, and a generally straight second blade edge 70. The first blade edge 68 is longer than the second blade edge 70.

The curved blade edge 66 of the toe thruster blade 62 preferably projects 1/16" to 1/32" from the side edge of the boot sole, and defines a thrusting blade edge.

The toe thruster blade 62 is preferably made of a single piece of steel about 3" in length and 1/16" in thickness. The blade 62 has vertical side edges and the thinness of the steel allows it to grip the ice.

The curved blade edge 66 extends along the inner edge of the toe of the boot so that it gives a continuous progressive grip of the ice adjacent the toe only. Since the blade edge 66 is curved, only a portion of the blade 66 adjacent the toe can catch on the flat surface of the ice at any one time.

Referring to FIG. 7, lines L1 and L2 show a maximum of ½" catching surface with the ice.

Figure 8:
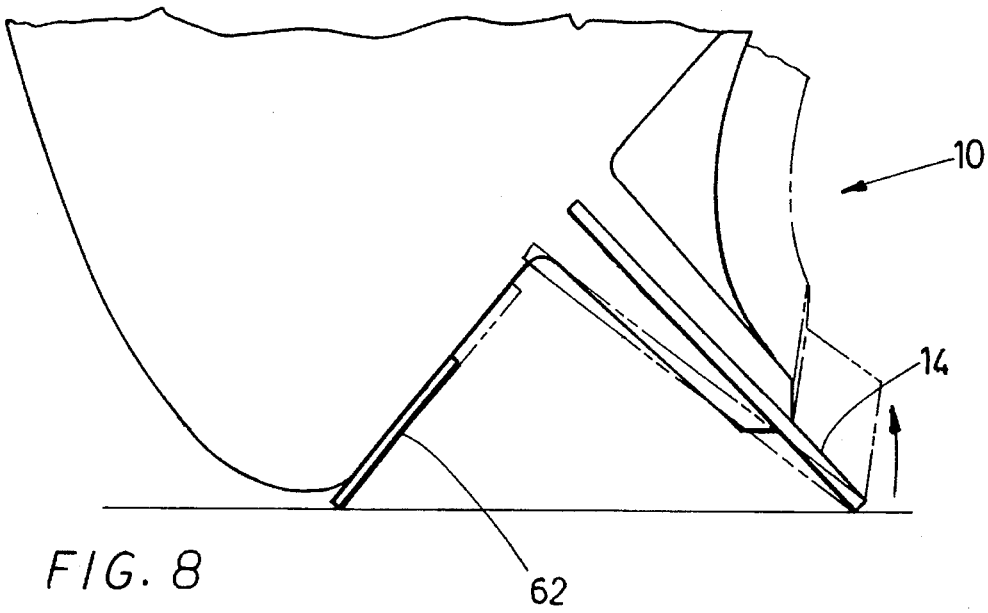
FIG. 8 is a front view of a boot and skate with a toe thrusting blade engaging the ice surface.

The continuous grip comes about because on the thrusting foot, the calf muscle flexes and lifts the heel (Phantom in FIG. 8).

A thrusting move begins with the heel on the ice and the blade edge 66 grips the ice at point A. When the heel lifts to 1½" above the ice, the gripping of the ice moves towards point B. When the heel is 2½" above the ice, the gripping of the ice is at point C. The gripping of the ice moves to point D and then point E when the heel is further lifted up.

This is important because the moves on which the thruster blade could catch do not involves much, if any, lifting of the heel. If the heel lifts 1½" off the ice in a thrusting move, the blade edge between A and B of about ¾" catches the ice surface.

As shown in FIG. 7, the curved blade edge 66 defines a first curved edge 72 extending between A and B and having a curvature of radius R2, a second curved edge 74 extending between B and D and having a curvature of radius R1, and a third curved edge 76 extending between D and E and having a curvature of radius R3.

Radius R1 is greater than radius R2, and radius R2 is greater than radius R3. The arc defined by the curved edge 74 at the centre of the blade edge 66 has a longer extension than the arcs defined by the curved edges 72 and 76 on both ends.

The curved edge 78 past A does not project from the side edge of the boot sole. It is ground down so that as goalie backs up with his feet at 45°, the thruster blade 62 will grab smoothly.

When the goalie makes an outward leg thrust with one leg, in order to power himself to move to the opposite side, and when the skate on the outthrust leg is rolled over at an extreme angle to the ice (FIG. 8), the thruster blade edge will contact and engage the ice in a manner which is generally speaking at or close to normal to the main direction of the leg thrust and will at the same time prevent the outthrust skate from slipping on the ice, thus preventing the goalie from falling.

If the thruster blade projects 1/16" from the side of the boot sole, it will be in contact with the ice when the outthrust leg angle to the ice is between 20° to 45°. From 45° and up, the thruster blade clears the ice.

Such thruster blades however are out of contact with the ice during normal active skating, during hockey or during practice, and will not interfere with the ability of the player to make abrupt, tight radius turns.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A toe thrusting edge blade for use with goalie ice hockey skates of the type having a skate blade attached to a sole of a boot having a toe end, said skate blade defining forward and rear ends, the forward end being located adjacent to the toe of the boot, and said boot toe defining an inside edge and an outside edge, and said toe thrusting edge blade comprising;

a plate portion attachable to said inside edge of said toe of said boot adjacent to and extending transversely sideways with respect to said skate blade, and spaced upwardly from said skate blade;

a free ice gripping edge portion on said plate portion extending from said inside edge of said toe of said boot, and, a generally curved thrusting blade edge formed along said free edge ice gripping portion, in turn defining, a first rearward blade edge for initial gripping of the ice when the skate on an outthrust foot rolls over with the heel of said boot still on the ice, a second intermediate blade edge extending forwardly from said first blade edge for gripping the ice when the heel is partially lifted up, and a third forward blade edge extending forwardly from said second blade edge for continuous gripping of the ice when the heel is further lifted up, and, wherein said first blade edge defines an arc of radius R2, said second blade edge defines an arc of radius R1, and said third blade edge defines an arc of radius R3, and wherein R1 is greater than R2, and wherein R2 is greater than R3, whereby said thrusting blade edge of said toe thrusting blade is in ice gripping contact with the ice surface when the skate on an outthrust foot rolls over at said toe at extreme angles to the ice surface both when said boot heel touches the ice and when said heel is raised upwardly during a toe thrusting movement.

2. A toe thrusting edge blade as claimed in claim 1 wherein said free edge portion extends ⅛" to 1/32" from said inside edge of said toe of said boot.

3. A toe thrusting edge blade as claimed in claim 1 wherein said extreme angles are from 20° to 45° when said free edge portion extends 1/16" from said inside edge of said toe of said boot.

4. A toe thrusting edge blade as claimed in claim 1 and wherein said plate portion incorporates attachment means formed therein, whereby the same may be secured to the toe of a boot, adjacent to said forward end of said skate blade.

5. A pair of ice hockey goalie skates having right and left boots having soles and defining toes and, heels and comprising;

skate blades secured to said soles, said skate blades defining forward and rear ends and a blade longitudinal axis extending therethrough, and toe thrusting blade plate members secured at said toes to the the soles of respective said boots, adjacent to but spaced transversely inwardly from said forward ends of respective said skate blades and wherein said skate blades define vertical longitudinal planes extending therealong, and wherein respective said toe thrusting blades define sharpened edges, portions of each said sharpened edge lying on an axis angled to converge with a respective said vertical longitudinal plane;

a free edge portion of each said plate member extending from the inside edge of said toe of a respective said boot, and, a generally curved thrusting blade edge formed along said free edge portion, in turn defining, a first rearward blade edge for initial gripping of the ice when the skate on an outthrust foot rolls over with the heel of said boot still on the ice, a second intermediate blade edge extending forwardly from said first blade edge for gripping the ice when the heel is partially lifted up, and a third forward blade edge extending forwardly from said second blade edge for continuous gripping of the ice when the heel is further lifted up, and, wherein said first blade edge defines an arc of radius R2, said second blade edge defines an arc of radius R1, and said third blade edge defines an arc of radius R3, and wherein R1 is greater than R2, and wherein R2 is greater than R3, whereby said thrusting blade edge of said toe thrusting blade is in contact with the ice surface when the skate on an outthrust foot rolls over at said toe at extreme angles to the ice surface both when said boot heel touches the ice and when said heel is raised upwardly during a toe thrusting movement.

* * * * *